US005083769A

United States Patent [19]

Young, Jr.

[11] Patent Number: 5,083,769

[45] Date of Patent: Jan. 28, 1992

[54] DUAL COLLATING MACHINE

[75] Inventor: John J. Young, Jr., Danbury, Conn.

[73] Assignee: Pitney Bowes Inc., Stamford, Conn.

[21] Appl. No.: 519,199

[22] Filed: May 4, 1990

[51] Int. Cl.[5] ..... B65H 29/00

[52] U.S. Cl. ..... 271/280; 271/303; 271/265; 271/288; 271/198; 414/790.7; 414/791.1; 270/58

[58] Field of Search ..... 270/58; 414/791.1, 790.7; 198/447; 271/9, 265, 266, 270, 301, 302, 303, 304, 198, 202, 288, 280, 212

[56] References Cited

U.S. PATENT DOCUMENTS

| | | | |
|---|---|---|---|
| 3,206,191 | 9/1965 | Handscho . | |
| 3,284,081 | 11/1966 | Huck . | |
| 3,542,362 | 11/1970 | Brockmuller et al. | 271/202 |
| 3,815,897 | 6/1974 | Hoe et al. | 271/9 |
| 3,908,527 | 9/1975 | Brockmuller et al. | 414/791.1 |
| 4,046,259 | 9/1977 | Dunlap | 214/6 |
| 4,078,790 | 3/1978 | Stocker | 271/213 |
| 4,223,882 | 9/1980 | Stocker | 270/21 |
| 4,431,322 | 2/1984 | Nally et al. | 400/605 |
| 4,518,161 | 5/1985 | Nakamura | 271/303 |
| 4,602,776 | 7/1986 | York et al. | 271/4 |
| 4,640,506 | 2/1987 | Luperti et al. | 414/790.7 |
| 4,729,282 | 3/1988 | Kasdorf | 83/26 |
| 4,732,261 | 3/1988 | Mattern et al. | 198/422 |
| 4,799,663 | 1/1989 | Golicz | 271/199 |
| 4,805,891 | 2/1989 | Luperti et al. | 271/212 |
| 4,925,180 | 5/1990 | Goliez | 414/790.7 |

FOREIGN PATENT DOCUMENTS

| | | | |
|---|---|---|---|
| 1445913 | 8/1976 | United Kingdom | 271/303 |

*Primary Examiner*—H. Grant Skaggs
*Attorney, Agent, or Firm*—Charles R. Malandra, Jr.; David E. Pitchenik; Melvin J. Scolnick

[57] ABSTRACT

A system embodying the present invention includes first structure having a first area for stacking at least one sheet to form a first collation, second structure having a second stacking area adjacent to the first stacking structure for stacking at least one sheet to form a second collation, and diverting structure arranged in a sheet path between the feeder and the first and second stacking structure for diverting the sheets fed by the feeder. The diverting structure having first and second operative positions for respectively diverting the sheets to the first stacking structure and to the second stacking structure. The system further provides control structure operatively coupled to the diverting structure for actuating the diverting structure to one of its operative positions and sensor structure operatively connected to the control structure for sensing when a sheet is conveyed to the diverting structure.

15 Claims, 5 Drawing Sheets

| FIG. 4A | FIG. 4B |
|---|---|

DUAL COLLATING MACHINE

FIELD OF THE INVENTION

The present invention relates to a collating machine and more particularly to a collating machine operating as part of an inserting apparatus for alternately collating sheets of paper in the same or reverse order in which they are fed.

BACKGROUND OF THE INVENTION

Collating machines are frequently used in line with other paper handling equipment as a means of assembling a plurality of sheets of paper into a particular, desired packet prior to further processing, which may include additional collating, folding and inserting. For further background, reference be made to U.S. Pat. Nos. 2,766,569 and 4,143,981. In a typical paper handling sequence involving an initial output consisting of a plurality of sheets of paper, to be later combined with subsequent output from other sheet feeding devices situated downstream, the initial output is fed from a stack, or a web supply, seriatim to the collator, which collates the output into the desired packets, either in the same or reverse order in which the sheets are fed to the collator. Each packet may then be folded, stitched or subsequently combined with other output from document feeding devices located downstream thereof and ultimately inserted into a mailing envelope.

U.S. Patent Nos. 4,640,506 and 4,805,891 respectively teach the incorporation in the collating machine of removable and moveable reverse order stacking devices for stacking sheets of paper being fed seriatim thereto from a singulating feeder in the same or reverse order as said sheets appear in said singulating feeder.

Generally, the speed of a feeder, which is feeding sheets to a collating machine, is faster than the speed of the collating machine. With known machines, the feeder must stop feeding sheets when a predetermined number of sheets representing a collation have been fed to the collating machine. When the last sheet of the collation is transported to the collation stack in the collating machine, the collator transports the collation to the next station in the paper handling equipment, at which time the feeder begins again to feed sheets for the next collation.

Thus known collators generally reduce the throughput of the paper handling equipment. Because the speed of the feeder is generally faster than a collator, and because the feeder must suspend feeding sheets until the collation accumulated in the collator has been transported from the collator, the feeder is continuously starting and stopping as as it feeds the collator and then waits for a collation to be transported from the collator. This results in additional wear and tear on the feeder mechanical components which is above and beyond the normal wear and tear of a sheet feeder running in a non-stop mode.

Accordingly, the present invention provides a collating machine which eliminates the need for stopping the sheet feeder during normal operation. Additionally, the present invention provides a collating machine which operates at a speed approaching or equal to the speed of the feeder.

SUMMARY OF THE INVENTION

It has been found that by alternately accumulating successive collations in two or more collating areas fed by a sheet feeder the sheet feeder can continuously feed sheets without having to stop for each collation to be removed from the collating machine. Such alternate accumulation in two collating areas significantly improves the rate at which the collating machine can accumulate successive collations and, therefore, improves the throughput of the inserting machine.

In accordance with the present invention, the above limitations or disadvantages are eliminated by providing the collating machine with dual collating capability including two separate collating areas and a deflector means operative to effect processing of successive collations alternately in each of the collating areas. The collations are alternately transported from the two collating areas through two discharge chutes which feed to a common discharge point. As one of the successive collations is being transported out of one of the collating areas, the other collating area is simultaneously accumulating the next one of the successive collations.

A system embodying the present invention includes first means having a first stacking area for stacking at least one sheet to form a first collation, second means having a second stacking area adjacent to the first stacking means for stacking at least one sheet to form a second collation, and diverting means arranged in a sheet path between the feeder and the first and second stacking means for diverting the sheets fed by the feeder. The diverting means have first and second operative positions for respectively diverting the sheets to the first stacking means and to the second stacking means. The system further provides control means operatively coupled to the diverting means for actuating the diverting means to one of its operative positions and sensor means operatively connected to the control means for sensing when a sheet is conveyed to said diverting means.

A further embodiment of the present invention includes first transport means for transporting the first collation from the first stacking means when the last sheet of the first collation is stacked in the first stacking area, second transport means for transporting the second collation from the second stacking means when the last sheet of the second collation is stacked in the second stacking area, and funnel means coupled to the first and second transport means for funneling the first and second collations transported from the first and second stacking means to a single paper path for further processing by paper handling equipment.

DESCRIPTION OF THE DRAWINGS

A complete understanding of the present invention may be obtained from the following detailed description of the preferred embodiment thereof, when taken in conjunction with the accompanying drawings wherein like reference numerals designate similar elements in the various figures and, in which.

DETAILED DESCRIPTION

Figure 1:
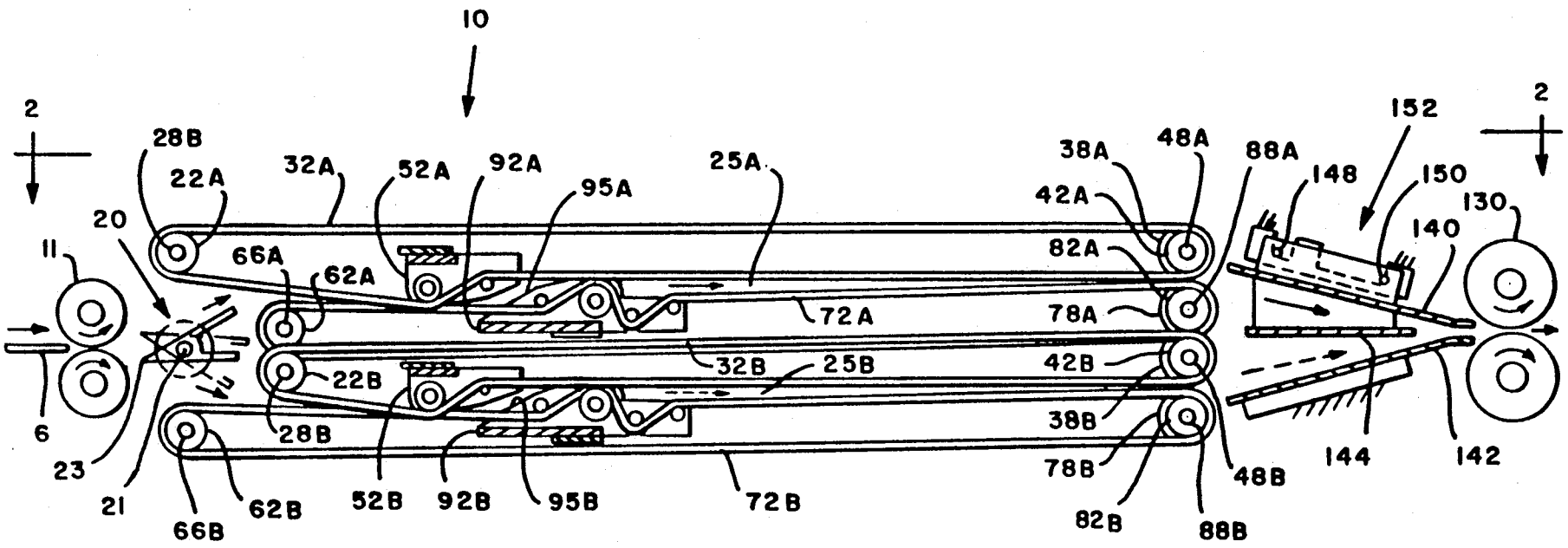
FIG. 1 is a side elevational view of a dual in-line collating machine in accordance with the present invention.

In describing the preferred embodiment of the present invention, reference is made to U.S. Pat. Nos. 4,640,506 and 4,805,891, both assigned to the assignee of the present invention, and incorporated herein for showing the capability of stacking sheets of paper in the same or reverse order in which they are fed to the collating machine.

Referring now to the drawings, the preferred embodiment of the present invention is shown wherein a dual collating machine 10 is comprised of two collating sections 25A and 25B, each of which is individually capable of accumulating a plurality of sheets in the same or reverse order in which the sheets are fed. In the description which follows, like components in each collating section are designated with the same reference numeral with an additional reference of letters A or B for the upper or lower section respectively of the dual collating machine.

Figure 2:
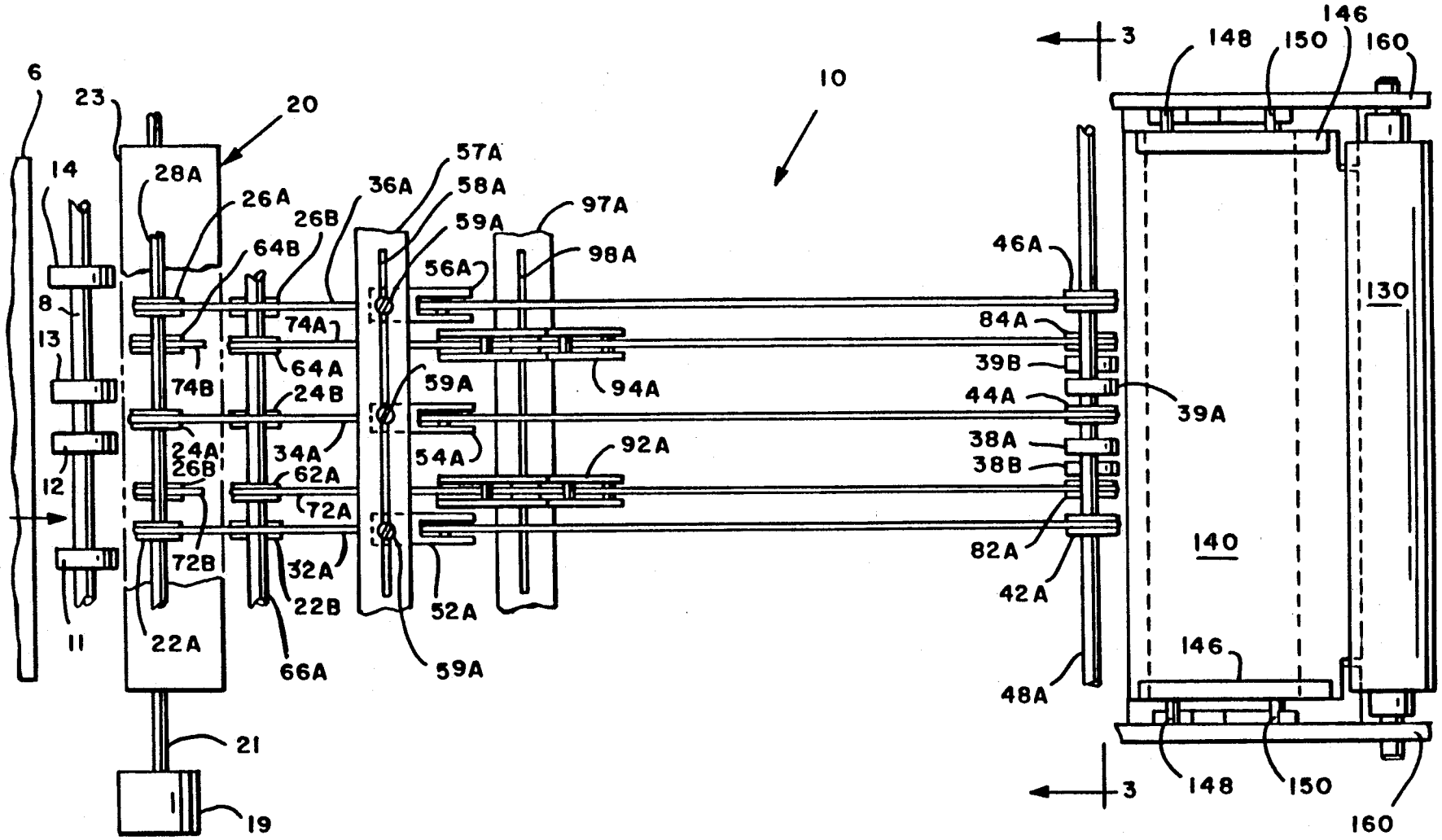
FIG. 2 is a top plan view taken on the plane indicated by the line 2—2 in FIG. 1.
Figure 3:
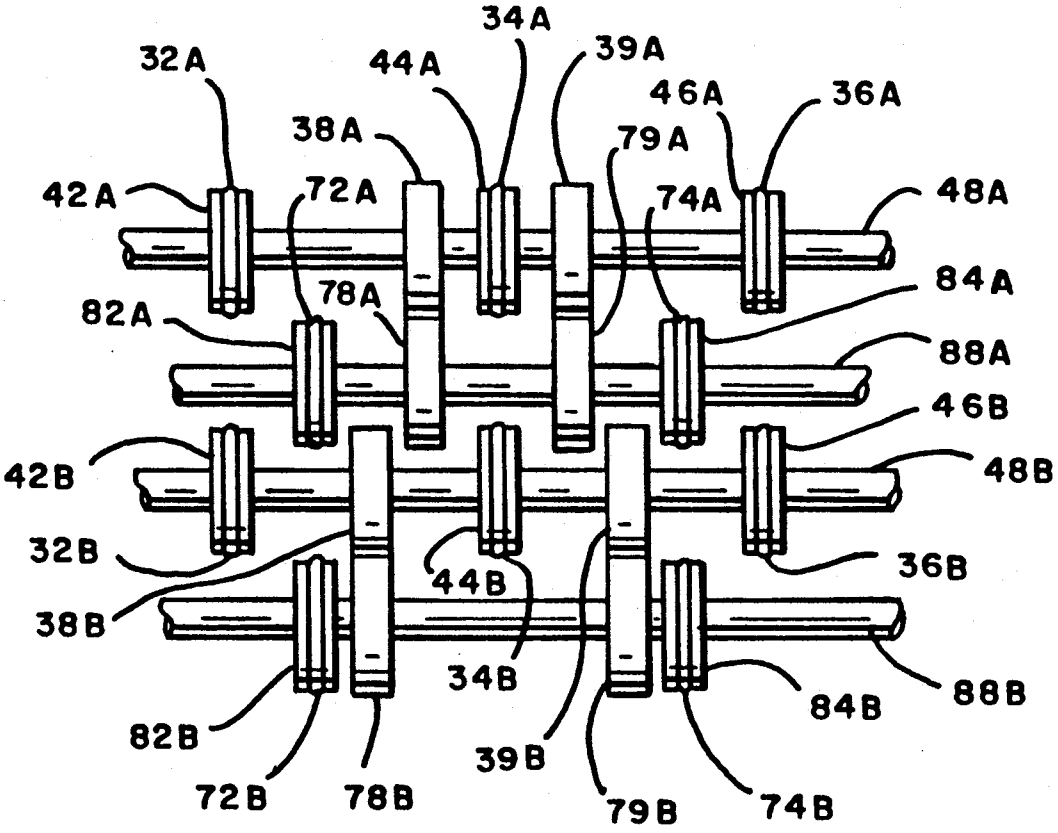
FIG. 3 is a sectional view taken on the plane indicated by line 3—3 in FIG. 2.

Referring now to FIGS. 1, 2 and 3, there is shown the dual collating machine 10 utilizing pairs of conveying rollers 11, 12, 13 and 14 which convey sheets of paper 6 fed seriatim from a singulating feeder 5 (not shown) to one of the two collating sections 25A and 25B of the collating machine. There is a wedge-shaped deflector 20, which has a tapered end 23 facing rollers 11, 12, 13 and 14. The deflector 20 is fixedly secured to a shaft 21 which pivots between two positions, as shown in FIG. 1. In the preferred embodiment of the present invention the pivoting motion is driven by a rotary solenoid 19 having an internal return spring, which is suitably fastened to the frame (not shown) of the collating machine 10. The shaft 21 is suitably journaled at one end to the frame of the collating machine 10, and at the other is operatively connected to the rotary solenoid 19. It will be understood that alternate means, such as, a solenoid/spring arrangement or a dual solenoid arrangement, can be used for pivoting deflector 20. In the preferred embodiment of the present invention, the length of the tapered edge of the deflector 20 exceeds the length of the leading edge of any sheet being processed by the collating machine 10.

As shown in FIG. 1, deflector 20 is positioned to deflect sheets to the upper collating section 25A of the dual collating machine. When the solenoid 19 is energized, the shaft 21 rotates to the right, causing the deflector 20 to move to its second position, shown in phantom, for diverting sheets to the lower collating section 25B. When the solenoid 19 is deenergized, the shaft 21 rotates to the left returning the deflector 20 to its first position.

It has been found that the present invention can be used to collate sheets fed from a two up burster. In such a configuration, the sheets from the upper web are diverted to collating section 25A and the sheets from the lower web are diverted to collating section 25B.

The following is a description of the collating sections 25A and 25B. Because each section is similarly structured with like components having the same reference numerals except for the A or B designated, the two sections will be described once without the A and B designations.

Four driven shafts 48, 88, 28 and 66 are rotatably mounted in the frame (not shown) of the dual collating machine 10 and operatively connected to a conventional drive system (not shown). Three idler pulleys 42, 44 and 46 are rotatably mounted on shaft 48 while two idle pulleys 82 and 84 are rotatably mounted on shaft 88. Three pulleys 22, 24 and 26 are operatively connected to the driven shaft 28 while two pulleys 62 and 64 are operatively connected to the driven shaft 66. A suitable, upper, endless, elastic conveyor belt 32 is suspended on the pulleys 22 and 42, a second suitable, upper, endless, elastic conveyor belt 34 is suspended on the pulleys 24 and 44, while a third, suitable, upper, endless, elastic conveyor belt 36 is suspended on the pulleys 26 and 46. Similarly, a suitable, lower, endless, elastic conveyor belt 72 is suspended on the pulleys 62 and 82 while a second suitable, lower, endless, elastic conveyor belt 74 is suspended on the pulleys 64 and 84.

There are two pairs of dump rollers 38 and 78, and 39 and 79, which are used as registration stops and exit rollers in the collating section 25. As best seen in FIG. 3, rollers 38 and 39 are operatively connected to driven shaft 48, and rollers 78 and 79 are operatively connected to driven shaft 88. As sheets 6 are conveyed into the collating section 25 shafts 48 and 88 are disengaged from the drive system (not shown) and held by a friction brake (not shown), causing the dump rollers 38, 39, 78 and 79 to be stationary and act as registration stops. When the last sheet of a collation 7 has been conveyed into the section 25, driven shafts 48 and 88 are engaged causing the dump rollers 38, 39, 78, 79 to rotate and convey the collation 7 from section 25.

As best shown in FIG. 2, three upper ramp guide blocks 52, 54, and 56 are fixedly secured to an upper mounting arm 57. Mounting arm 57 is transversely secured between a pair of brackets 96 (not shown) which are slidably mounted to the frame of the collating machine 10 in a known manner such as shown in U.S. Patent No. 4,805,591. A pair of lower ramp guide blocks 92 and 94 are mounted to a lower mounting arm 97. Mounting arm 97 is also transversely secured between the pair of brackets 96 (not shown). The blocks 52, 54, and 56 are slidable transversely owing to bolts 59 which are slidably mounted in a channel 58 which traverses the arm 57. Similarly, blocks 92 and 94 are slidable transversely owing to bolts 9 (not shown) which are slidably mounted in a channel 98 which traverses the arm 97. The lower guide blocks 92 and 94 include a lower inclined end 95 on the upstream side for intercepting a leading end of sheets 6 as they are individually conveyed through the collating machine 10 after having been separated by the upstream singulating feeder 5 (not shown). For further information regarding the slidable mounting and positioning of the blocks refer to U.S. Pat. No. 4,805,891.

Figures 4, 4A:
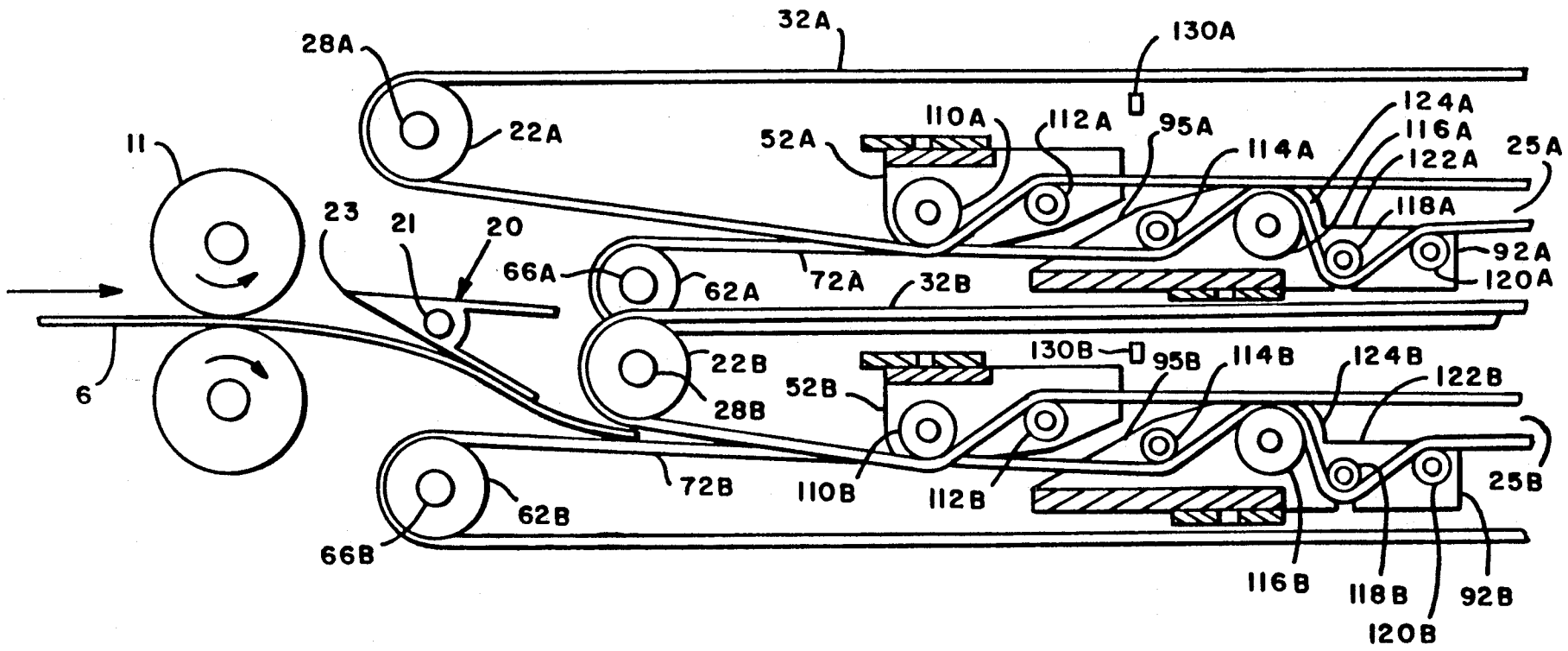
FIG. 4 is a vertical sectional view of the collating machine seen in FIG. 1 arranged to accumulate sheets in the lower collating section as the collation in upper collating section is transported out of the upper collating section.

Suitable paper side guides 106 and 108 (not shown) are secured to side panels on each side of the collating machine 10 for guiding the sheets 6. For additional guidance of sheets 6, each of the upper guide blocks 52, 54 and 56 includes a pair of suitably journaled idler rollers 110 and 112 and each of the lower guide blocks 92 and 94 includes four suitably journaled idler rollers 114, 116, 118 and 120, as best seen in FIGS. 1 and 4. The idler rollers 110 and 112 provide and define the appropriate path for the upper belts 32, 34 and 36 while the four idler rollers 114, 116, 118 and 120 provide and define the appropriate path for the lower belts 72 and 74. The construction of the belts 32, 34, 36, 72 and 74 are of an "O" ring nature, but it is possible to utilize a flat belt, as long as the belt material is elastic, or there is provided an adequate belt tensioning system, the likes of which are well known by those skilled in the art Referring now to FIG. 4, The lower guide blocks 92 and 94 are seen to include an L-shaped portion on the downstream side defined by horizontal support surfaces 122 and vertical abutment surfaces 124. It should be noted that rollers 116 and 118 are so arranged that conveyor belts 72 and 74 are maintained remote from the surfaces 122 and 124.

A pair of conveying rollers 130 are suitably journaled, supported and driven by a drive system (not shown) for conveying collations which are fed from the collation sections 25A and 25B. The collations fed from sections 25A and 25B are funneled into one paper path by three plates 140, 142 and 144. Plates 140 and 144 form an upper funnel which receives collations 7A fed from collating section 25A. Plates 142 and 144 form a lower funnel which receives collations 7B (not shown) fed from collating section 25B. Plate 142 is rigidly mounted to the frame 160 of the collating machine in a suitable manner. Plates 140 and 144 are rigidly connected to vertical side plates 146 (see FIG. 2) to form an upper funnel assembly 152 which is removably mounted to the frame 160. In the preferred embodiment of the present invention, the funnel assembly 152 includes pins 148 and 150 secured to each side plate 146 for removably mounting assembly 152 to slots suitably positioned in the frame 160. The assembly 152 is removable for clearing a paper jam which may occur in either funnel path. It is noted that a paper jam occurring in collating sections 25A or 25B can be accessed by lifting the upper collating section 25A which is pivotably mounted at the downstream end in a conventional manner.

Having explained the details of the apparatus hereinabove, the mode of operation will now be explained. As seen in Figure the deflector 20 is positioned to deflect sheets 6 to the upper collating section 25 A. As the singulating feeder 5 (not shown) conveys a supply of sheets 6 seriatim to the collating machine 10, sheet 6 is conveyed to the upper collating section by the pairs of conveying rollers, 11, 12, 13 and 14. The sheets 6 are advanced one at a time in collating section 25A to form a collation 7A. The sheets forming collation 7A come to rest against dump rollers 38A, 39A, 78A and 79A which are stopped as collation 7A is being accumulated.

When the last sheet for collation 7A is conveyed by the singulating feeder 5, the solenoid 19 is energized causing the deflector 20 to pivot to its alternate position. In the preferred embodiment of the present invention, a sensor 130 is positioned upstream from the collating machine for detecting the trailing edge of the last sheet of each collation 7 and for generating a signal which results in the solenoid 19 being energized or deenergized. The sensor is positioned so that the leading edge of the last sheet is conveyed past deflector 20 before the sensor detects the trailing edge. It will be understood that other known methods, such as, placing a sensor in the collating machine, can be used for detecting when the last sheet has been conveyed past the deflector 20. Another alternate method for controlling the pivoting of deflector 20 is to have the deflector 20 pivot after a predetermined number of sheets are fed to a collating section 25.

The singulating feeder, without stopping, pausing or slowing down, continues to feed sheets 6 to the collating machine 10. As seen in FIG. 4A, the first sheet 6 of the collation 7B (not shown) is deflected to the lower collating section 25B.

It will be understood by those skilled in the art that the speed of the singulating feeder 5 and the collating machine 10 can be adjustably controlled based on the number of sheets being accumulated in each collation so that the singulating feeder 5 and the collating machine 10 cooperatively operate to accumulate alternately in collating sections 25A and 25B collations from a continuously feeding feeder 5.

Figure 4B:
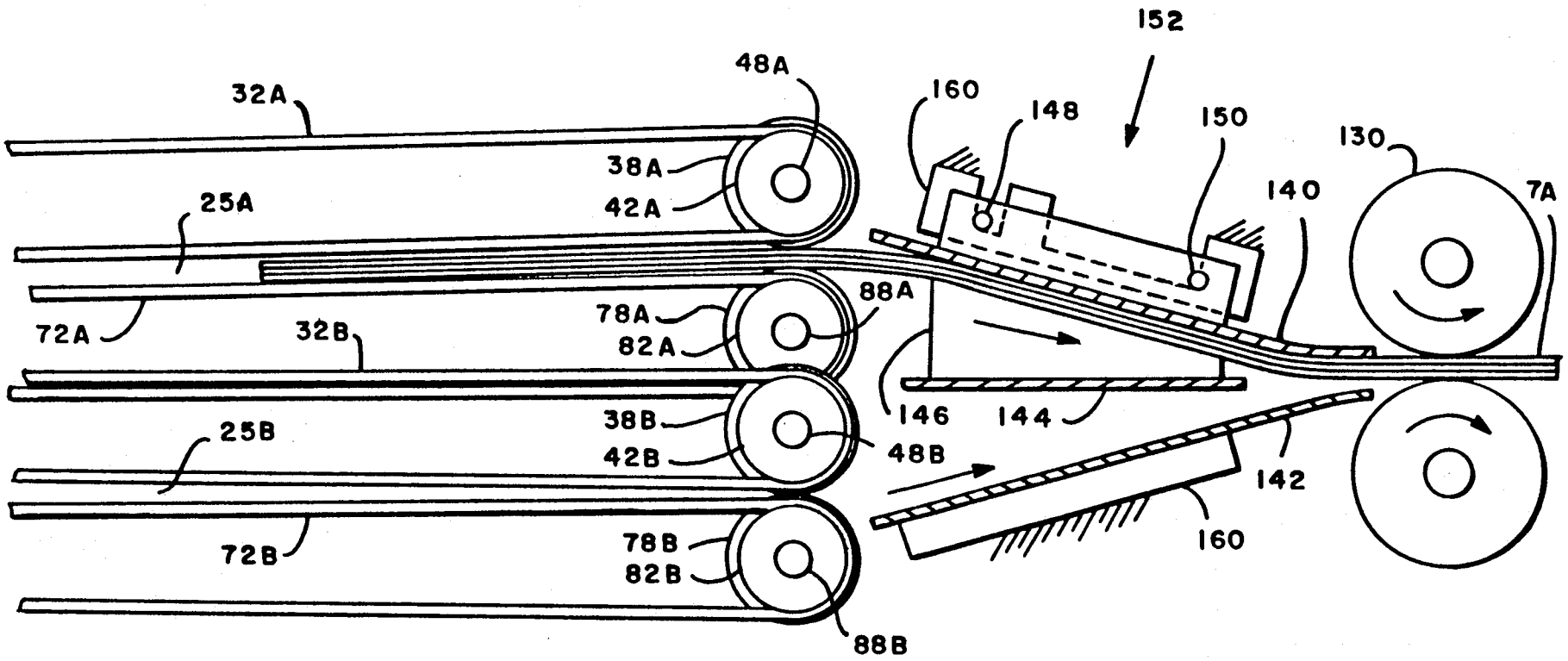

FIG. 4B shows collation 7A being conveyed out of collating section 25A as sheet 6 is being deflected and conveyed to collating section 25B in FIG. 4A. It will be understood by those skilled in the art that the status and location of collation 7A with regard to the location of the first sheet 6 of collation 7B depends on several factors including the number of sheets in collation 7A and the relative operating speed of the singulating feeder 5 and the collating machine 10. It is noted that the location of collation 7A and sheet 6 in FIGS. 4A and 4B are for description purposes only.

While the invention has been disclosed and described with reference to a single embodiment thereof it will be apparent, as noted above that variations and modifications may be made therein. It is, thus, intended in the following claims to cover each variation and modification that falls within the true spirit and scope of the present invention.

We claim:

1. A collating machine for stacking a series of individually spaced sheets of paper fed seriatim from a feeder comprising:

a housing;

first means mounted to said housing for individually conveying and stacking at least one sheet to form a first collation at a first stacking area;

second means adjacent to said first means for individually conveying and stacking at least one sheet to form a second collation at a second stacking area;

diverting means, arranged in a sheet path between said feeder and said first and second means, for diverting said sheets fed seriatim by said feeder, said diverting means having first and second operative positions for respectively diverting said sheets to said first means and to said second means;

control means operatively coupled to said diverting means for actuating said diverting means to one of its operative positions; and sensor means operatively connected to said control means for sensing when a sheet is conveyed to said diverting means, said sensor means senses when a last sheet of a predetermined number of sheets of said first and said collations is conveyed to said diverting means and transmits to said control means a signal indicating said last sheet is conveyed, and said control means actuates said diverting means upon receiving said signal.

2. A collating machine according to claim 1, further comprising:

first transport means for transporting said first collation from said first stacking area when the last sheet of said first collation is stacked by said first means;

second transport means for transporting said second collation from said second stacking area when the last sheet of said second collation is stacked by said second means;

funnel means downstream of said first and second transport means, for funneling said first and second collations transported from said first and second stacking areas to a single paper path for further processing by paper handling equipment.

3. The collating machine according to claim 2 wherein said funnel means comprises a chute having first and second channels through which said first and second collations respectively pass when being transported from said first and second stacking areas.

4. A collating machine according to claim 1, wherein said sensor means senses each sheet being conveyed to said diverting means and transmits to said control means a signal indicating each of said sheets conveyed, and said control means actuates said diverting means when a predetermined number of sheets representing one of said first and second collations are fed.

5. A collating machine according to claim 1 wherein said diverting means includes a deflector coupled to and pivotably controlled by at least one solenoid.

6. The collating machine according to claim 1 wherein said first stacking area comprises a first lower ramp guide block defining an upstream end of said first stacking area, and said second stacking area comprises a second lower ramp guide block defining an upstream end of said second stacking area.

7. The collating machine according to claim 1 wherein said first and second means each further comprise:

a plurality of upper, endless, elastic belts rotatably mounted to said housing;

a plurality of lower, endless, elastic belts rotatably mounted to said housing, each of said upper and lower belts having an upper and lower reach, wherein the lower reach of the upper belts is situated slightly above the upper reach of the lower belts to thereby frictionally engage and transport the sheets of paper;

upper and lower frame members slidably mounted to said housing, said frame members being movable between an upstream and a downstream position;

an upper ramp guide block secured to said upper frame member;

a lower ramp guide block secured to said lower frame member, whereby when said lower frame is located in an upstream position colation is effected in the same order as said sheets are fed by said feeder, and when said frame is located in said downstream position collation in the reverse order is effected.

8. The collating machine according to claim 1 wherein said first and second means and said diverting means operate in a manner wherein the feeder continuously feeds seriatim the sheets which form said first and second collations.

9. A collating a series of individually spaced sheets machine for collating sheets of paper fed seriatim thereto from a singulating feeder, comprising:

means for conveying sheets of paper fed from the feeder;

diverting means adjacent said conveying means for individually diverting said sheets to first and second paths to form first and second collations, respectively, said diverting means having first and second operative positions respective said first and second paths;

a lower collating section adjacent said diverting means, said lower collating section defining said first path;

an upper collating section superposed to said lower collating section, said upper collating section defining said second path;

wherein each of said upper and lower collating sections include at least one upper, endless, elastic belt and one lower, endless, elastic belt, each of said belts having an upper and lower reach, and wherein the lower reach of the upper belt is situated slightly above the upper reach of the lower belt to thereby frictionally engage and transport said sheets of paper, each of said collating sections further including ramp means operatively coupled to said upper and lower belts for directing each of said sheets of paper to a stacking portion of said collating section whereby collations of said sheets are formed;

control means operatively coupled to said diverting means for alternating said diverting means between said first and second operative positions; and sensor means operatively connected to said control means for sensing when a sheet is conveyed to said diverting means, said sensor means senses when a last sheet of a predetermined number of sheets of said first and second collations is conveyed to said diverting means and transmits to said control means a signal indicating said last sheet is conveyed, and said control means actuates said diverting means upon receiving said signal.

10. The collating machine according to claim 9 further comprising:

first transport means for transporting said first collations from said first collating section when the last sheet of each of said first collations have been accumulated in said stacking portion of said first section;

second transport means for transporting said second collations from said second collating section when the last sheet of each of said second collations have been accumulated in said stacking portion of said second section;

funnel means adjacent downstream said first and second transport means for funneling said first and second collations being transported from said first and second collating sections to a single paper path for further processing.

11. The collating machine according to claim 10 wherein said diverting means is in said second operative position when said first transport means is transporting the last accumulated one of said first collections from said first collating section, and is in said first operative position when said second transport means is transporting the last accumulated one of said second collations from said second collating section.

12. The collating machine according to claim 9 wherein said ramp means is movable between an upstream and a downstream position whereby when in the upstream position, collation is effected in the same order as said sheets are fed by said feeder, and when in the downstream position, collation in the reverse order is effected.

13. A collating machine for stacking and collating sheets of paper conveyed seriatim thereto along a single paper path in the same or reverse order as said sheets are conveyed, comprising:

means for receiving the sheets of paper fed seriatim along the single paper path;

means adjacent said receiving means for diverting the sheets to first and second paper paths, said diverting means having first and second operative positions corresponding to said first and second paper paths, wherein said diverting means alternates said operative positions when a last sheet of a collation is being conveyed to one of said first and second paper paths;

a first collating section adjacent said diverting means for stacking the sheets diverted to said first paper path;

a second collating section adjacent said diverting means and said first collating section for stacking the sheets diverted to said second paper path;

a chute downstream of said first and second collating sections, said chute having two channels through which collated stacks of the sheets pass as said stack of sheets are conveyed from said first and second collating sections respectively to a subsequent single paper path.

14. The collating machine of claim 13 further comprising control means operatively coupled to said diverting means for alternating said diverting means between said first and second operative positions.

15. The collating machine of claim 13 further comprising sensor means operatively connected to said control means for sensing when a sheet is conveyed to said diverting means.

* * * * *